US005697871A

United States Patent [19]

Landfair

[11] Patent Number: 5,697,871

[45] Date of Patent: Dec. 16, 1997

[54] VARIABLE WEIGHT DUMBBELL AND JUMP ROPE

[75] Inventor: Craig D. Landfair, Pulaski County, Ark.

[73] Assignee: U.S.-China Trading Corp., Willowbrook, Ill.

[21] Appl. No.: 783,017

[22] Filed: Jan. 14, 1997

Related U.S. Application Data

[60] Provisional application No. 60/011,015, Feb. 1, 1996.

[51] Int. Cl.[6] ..... A63B 5/20

[52] U.S. Cl. ..... 482/82; 482/81; 482/107

[58] Field of Search ..... 482/82, 81, 104–108; 24/522, 671, 129 B, 129 D; 285/316, 304

[56] References Cited

U.S. PATENT DOCUMENTS

| | | |
|---|---|---|
| 1,044,018 | 11/1912 | Calvert . |
| 2,719,038 | 9/1955 | Massa . |
| 3,502,329 | 3/1970 | Brazier . |
| 3,771,758 | 11/1973 | Little . |
| 3,771,785 | 11/1973 | Speyer . |
| 3,913,908 | 10/1975 | Speyer . |
| 3,971,556 | 7/1976 | Petrie . |
| 4,021,040 | 5/1977 | Inoue . |
| 4,101,123 | 7/1978 | Anthony . |
| 4,330,118 | 5/1982 | Race . |
| 4,489,934 | 12/1984 | Miller . |
| 4,566,690 | 1/1986 | Schook . |
| 4,579,337 | 4/1986 | Uyeda . |
| 4,639,979 | 2/1987 | Polson . |
| 4,646,398 | 3/1987 | Myhrman . |
| 4,722,523 | 2/1988 | Yang . |
| 4,773,641 | 9/1988 | Metz . |
| 4,778,173 | 10/1988 | Joutras . |
| 4,787,624 | 11/1988 | Grant . |
| 4,801,137 | 1/1989 | Douglass . |
| 4,817,944 | 4/1989 | Anderson . |
| 4,880,229 | 11/1989 | Broussard . |
| 4,893,810 | 1/1990 | Lee . |
| 5,163,887 | 11/1992 | Hatch . |
| 5,295,934 | 3/1994 | Collins et al. . |

*Primary Examiner*—Jerome Donnelly
*Attorney, Agent, or Firm*—Ray F. Cox, Jr.

[57] ABSTRACT

A combination dumbbell and jump rope with interchangeable weight units is disclosed. Various weights may be quickly and easily attached or detached from the handles by pushing a button on the end of the weight unit. When pushed, the button releases ball bearings that lock the weight unit into grooves on the handle. The jump rope length is easily adjustable to accommodate each individual user by retracting a portion of the rope inside the hollow rope handles. Retraction is accomplished by the release of a variable-length clamping mechanism. When closed, the clamping mechanism presses ball bearings against the jump rope cable to hold it firmly in place. When released, the rope may move freely within a jump rope cable guide for length adjustment.

8 Claims, 3 Drawing Sheets

VARIABLE WEIGHT DUMBBELL AND JUMP ROPE

This application is a provisional application of Ser. No. 60/011,015 filed Feb. 1, 1996 now abn.

BACKGROUND OF THE INVENTION

The present invention relates to exercise equipment, more particularly to a combination dumbbell and jump rope handle that has quickly interchangeable weights. The present invention also relates to a jump rope whose length is easily adjustable to accommodate each individual user.

Dumbbells are used for a myriad of fitness and athletic training purposes. Two types of dumbbells are generally used, each of which has particular advantages and disadvantages. One type of dumbbell has a specific amount of weight permanently attached to a handle. This type of dumbbell requires one to keep dumbbells in every weight which the user may desire to use. This can be expensive since different weights are used for different purposes, and also because users often increase the weight used for a particular purpose as their fitness level increases.

A second type of dumbbell allows the user to attach different amounts of weight to its handle, thereby allowing the continued use of the same handle as the amount of weight required changes. One popular dumbbell in this category is the "Heavy Hands" handweights produced by AMF Industries. However, changing the amount of weight on this type of dumbbell can be time-consuming and difficult. Furthermore, some variable-weight dumbbells may raise safety concerns as the attached weight can sometimes slide off of the handle if not properly secured and can thereby injure the user or a bystander. This is particularly a concern when the handle does not contain grooves or threads to receive the locking attachment which holds the weight onto the handle, but instead relies simply on friction to hold the weight in place.

Devices to lock weights onto barbell handles are well known in the prior art. For example, U.S. Pat. No. 5,295,934 is directed to a collar and sleeve arrangement for holding weights onto the handle of a barbell. Spheres mounted in the collar lock into grooves on the barbell handle to hold the collar in place. The collar is released by compressing flanges extending from the separate sleeve and collar pieces toward one another. U.S. Pat. No. 5,163,887 also discloses a collar and sleeve arrangement, but the device taught by this patent is released from the handle by twisting the outer collar relative to the sleeve so that steel balls riding against the sleeve are rotated into deeper grooves within the collar. U.S. Pat. No. 4,893,810 discloses a sleeve and collar that is released by pulling on a flange extending from the device's sleeve. U.S. Pat. No. 4,579,337 discloses a sleeve and collar device that is threaded together, such that twisting the sleeve relative to the collar disengages a locking ball.

Each of the aforementioned patents are directed to a sleeve and collar arrangement used to secure weight units to a handle. The sleeve and collar arrangements are separate from the weights which they secure to the handle. None of these patents therefore teach a device in which no separate sleeve and collar unit is required. None teaches a means for integrating a weight with a locking mechanism, such that variable-weight dumbbells may be accomplished without a separate locking unit, but with only a handle and variable-sized weights.

The "Heavy Hands" handweights and similar dumbbells do not require separate locking mechanisms, but are slow and cumbersome to use. Additional weights added to these must be threaded onto the handle, requiring the user to stop for a substantial length of time during exercise if more or less weight is needed. During this lag time, the user's heart rate will fall, thereby reducing the cardiovascular benefit of the exercise accomplished. It would therefore be beneficial to have a system of interchangeable weights that could be quickly and easily attached or detached from the dumbbell handle during an exercise or training routine.

Jump ropes, like dumbbells, are also used for many fitness and training purposes. For safe and efficient exercise, the length of the jump rope must be precisely fitted to its user. Maintaining numerous jump ropes in varying lengths to accommodate different users can be expensive. Therefore, a jump rope whose length is adjustable for each user is desirable. To reduce twisting of the rope, a jump rope may ride on ball bearings in the handles so that it rotates freely. Furthermore, a fitness benefit could be derived by allowing the user to vary the amount of weight integrated into the jump rope handles. Variable-weight handles would also allow the jump rope to be used for different purposes and by persons of varying levels of fitness.

Jump ropes featuring ball bearings to reduce wear on the rope and to enable quicker and smoother jumping are well known in the prior art. U.S. Pat. No. 4,101,123 discloses such a jump rope. U.S. Pat. No. 4,330,118 disclosed a jump rope handle that features a bent tube, one end rotatably riding on the ball bearings and the other end attached to the rope. This tube further reduces wear on the rope, and may be removed to replace the rope when worn. None of these devices allow the length of the rope to be easily and quickly changed.

Jump ropes with variable-weight handles are also well known in the prior art. U.S. Pat. No. 2,719,038 discloses a jump rope with a means for bolting weights between the handle and rope. U.S. Pat. No. 4,801,137 discloses a jump rope whose handles are hollow to receive weights internally. The weights are of variable length, and thus must be held in place by a spring in a cap on the end of the handle. U.S. Pat. No. 4,787,624 teaches a simple C-shaped adapter for connecting "Heavy Hands" handweights to a jump rope. However, none of these devices allow the user to change the amount of weight attached quickly and easily.

SUMMARY OF THE INVENTION

These and other disadvantages and limitations of the prior art are overcome by the present invention.

The present invention comprises a hollow handle to which various-sized weights may be attached at one end. In a preferred embodiment, the weight units have one or more spheres which lockingly engage with grooves on one end of the handle to connect the weight unit firmly to the handle. The weight unit features a "push button" head that is spring loaded so as to hold it in an extended position.

To either connect or disconnect the weight unit and handle, the user need only depress the head of the weight unit. Depression of the head allows the spheres to retract, thereby allowing the weight unit to slide on or off the handle easily. If the weight unit is to be connected, it is slid onto the handle until a flange or other stop within the weight unit rests against the end of the handle. In this position, the spheres will align with the grooves along the handle. The head can then be released, which forces the spheres into the grooves of the handle. The weight unit is thus locked onto the handle until the head is again depressed.

The end of the handle opposite the weight unit attachment receives the attachment head of the jump rope unit. The attachment head is preferably secured to the handle in a way somewhat similar to the way a socket is secured to a socket wrench. A groove lies along the exterior of the handle near the rope unit end. The cap-shaped attachment head fits over this end of the handle. The attachment head has spring-loaded spheres which align with the grooves on the handle, locking the jump rope unit in place. To remove the jump rope unit, the user simply pulls the attachment head hard enough to overcome the spring force holding the spheres in the grooves on the handle.

The interior of the attachment head preferably houses a bearing assembly. Within the bearing assembly rides the jump rope cable guide that houses the jump rope cable. The rope extends through the jump rope cable guide, with a clamp at each end so that the rope may not slip out of the jump rope cable guide completely. The jump rope cable guide may rotate freely within the attachment head by riding within the bearing assembly, thereby preventing the rope from twisting as the user exercises. The jump rope cable guide is bent at an angle as it emerges from the housing to further reduce wear on the rope.

The jump rope cable guide also features a variable-length clamping mechanism, which allows the user to easily retract a given portion of the rope within the hollow handle, or extend a portion of the rope so retracted. The clamping mechanism holds the rope in place until the user desires to adjust the rope's length. By temporarily releasing the variable-length clamping mechanism, the user may retract a portion of the rope into the interior of the hollow handle, or extend a portion of the rope previously retracted. The clamping mechanism typically holds the rope in place by forcing ball bearings against the jump rope cable, thereby pinching the jump rope cable between them.

It is therefore an object of the present invention to provide for a variable-weight dumbbell and jump rope that does not require a separate locking mechanism to hold weights into place on the dumbbell handle.

It is also a object of the present invention to provide for a variable weight dumbbell and jump rope that allows weights to be changed quickly and easily so that exercise is not significantly interrupted by the weight-changing process.

It is a further object of the present invention to provide for a jump rope that allows the user to easily and quickly adjust the length of rope to fit that particular user.

These and other objects and advantages of the present invention will be apparent from a consideration of the detailed description of the preferred embodiments in conjunction with the drawings which are briefly described as follows:

DETAILED DESCRIPTION OF THE PREFERRED EMBODIMENTS

Figure 1:
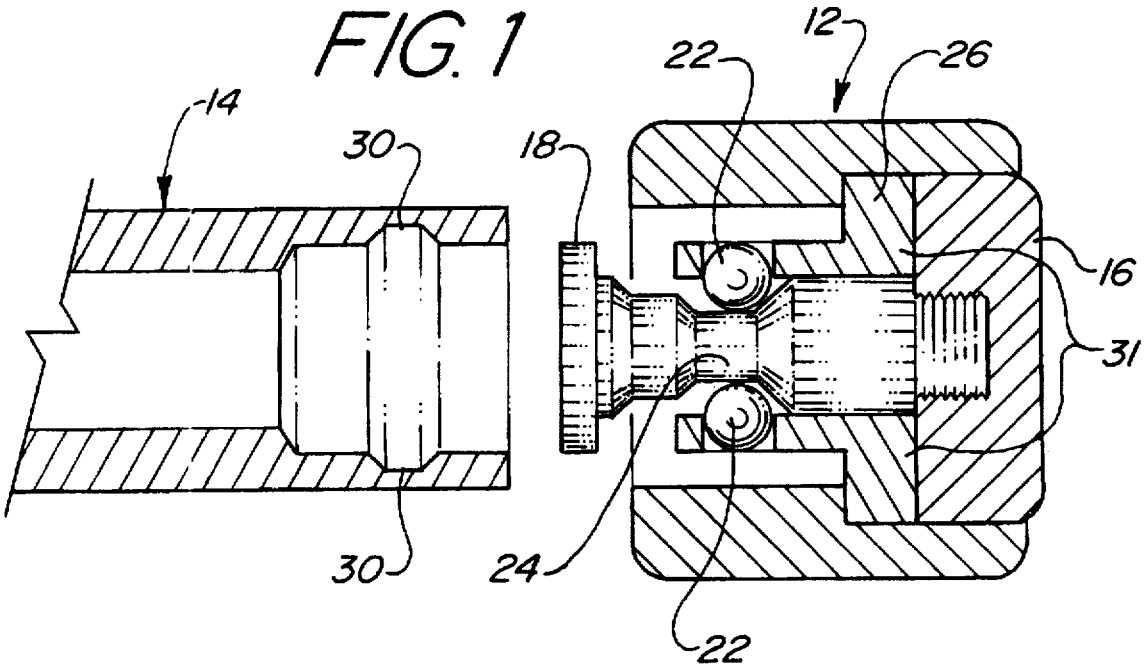
FIG. 1 is a side elevation view, partially in cross-section, of the end of the handle that attaches to the weight unit with the weight unit unattached.

FIG. 1 shows, in a preferred embodiment, weight unit 12 and the end of handle 14 that attaches to the weight unit, with push button head 16 depressed. Push button head 16 is rigidly attached to piston 18, both of which slide within housing 13. When push button head 16 is depressed, spring 20 (visible in FIG. 2) is compressed. Depressing push button head 16 moves piston 18 forward longitudinally, so that ball bearings 22 ride against a narrow portion 24 of piston 18. This allows ball bearings 22 to slip below the outer circumference of insert 26 which holds ball bearings 22 in place.

Figure 2:
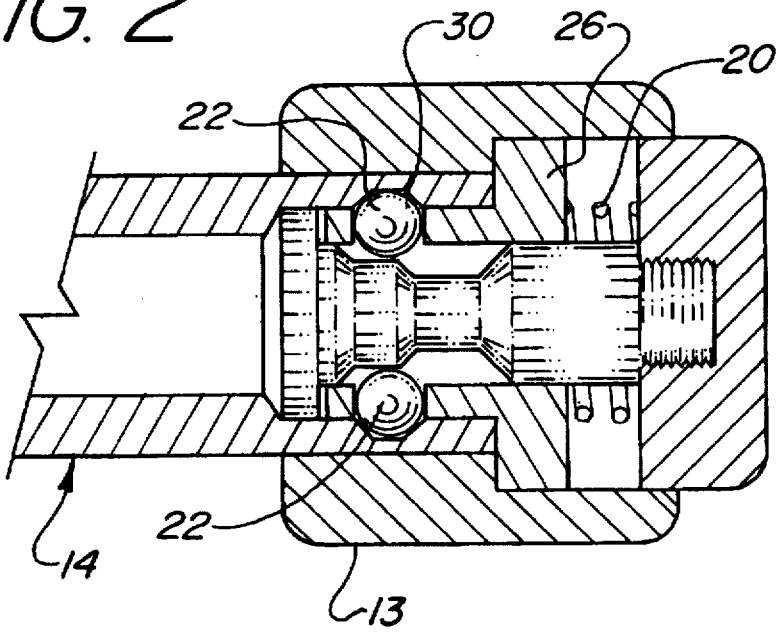
FIG. 2 is a side elevation view, partially in cross-section, of the end of the handle that attaches to the weight unit with the weight unit attached.

FIG. 2 shows weight unit 12 attached to handle 14, with push button head 16 in the undepressed position. In this state, spring 20 is extended. The force of spring 20 urges push button head 16 into the extended position, and thus urges piston 18 longitudinally backward, away from the end of weight unit 12 that attaches to handle 14. This causes a thicker portion of piston 18 to ride against ball bearings 22, forcing ball bearings 22 to extend outside of the outer circumference of insert 26. When handle 14 is inserted into weight unit 12 as shown in FIG. 2, the ball bearings thus lock into groove 30 along the interior of handle 14.

Referring to FIGS. 1 and 2, the means for locking the weight unit to the handle in the preferred embodiment may be understood. When push button head 16 is depressed, ball bearings 22 may slide inside the outer circumference of insert 26 as described above. This allows handle 14 to slip into the space between the outer circumference of insert 26 and the inner circumference of weight unit housing 30. When fully inserted, the end of handle 14 rides against a flange 31 on insert 26. The push button head 16 may then be released, which causes ball bearings 22 to be forced outside the outer circumference of insert 26 by piston 18. Ball bearings 22 thus lock into the groove 30 on handle 14, firmly securing weight unit 12 to handle 14. Depressing push button head 16 will allow the user to remove weight unit 12 from handle 14 in a similar manner.

Figure 3:
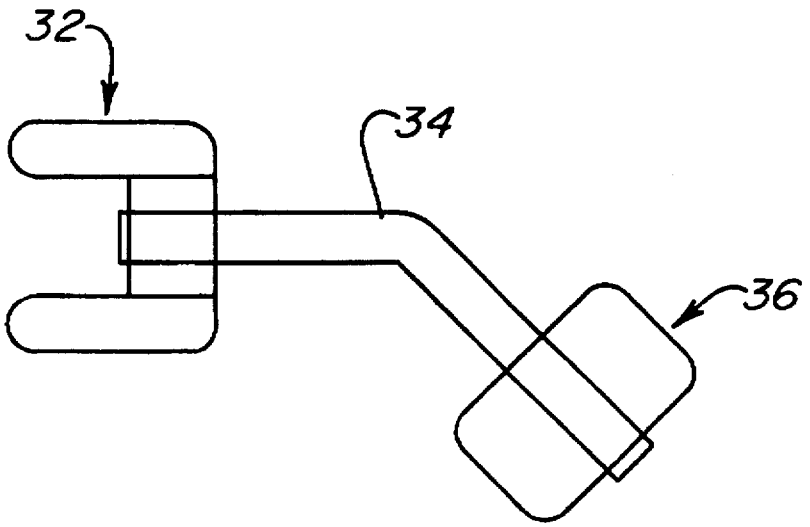
FIG. 3 is a sectional view of the jump rope unit.

Referring now to FIG. 3, the structure of the jump rope unit in a preferred embodiment may be described. Attachment head 32 forms a cap that fits over the end of handle 14 opposite weight unit 12 (not shown). One end of jump rope cable guide 34 rides within attachment head 32, and the opposite end extends outwardly at an angle, preferably around 45 degrees. Variable-length clamping mechanism 36 circumscribes jump rope cable guide 34 near the end extending outward from attachment head 32.

Figure 5:
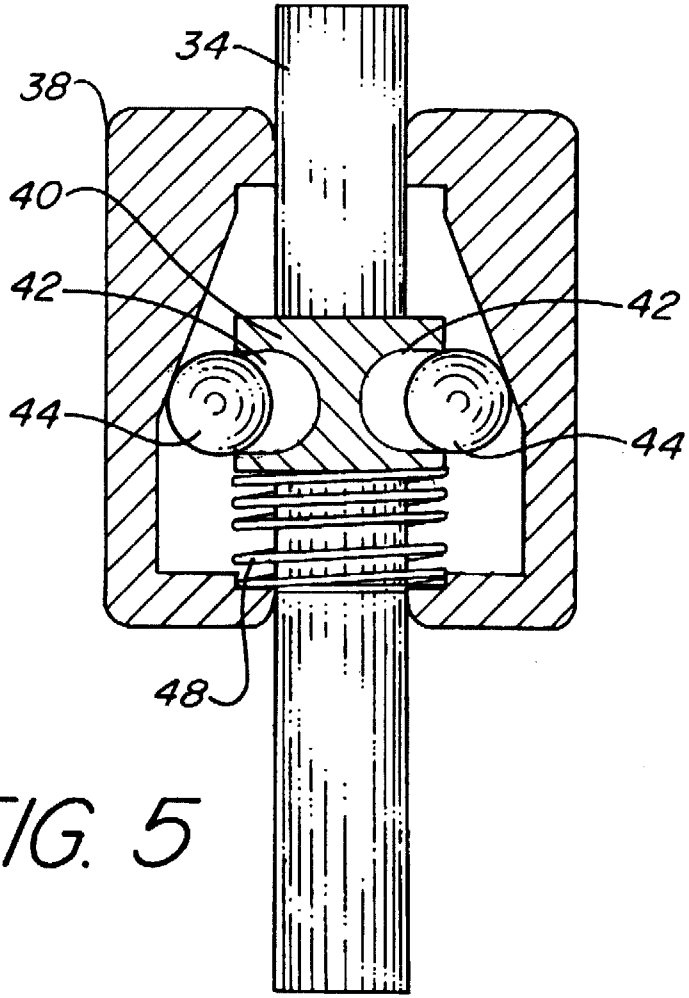
FIG. 5 is a sectional view of the variable-length clamping mechanism with the jump rope cable released and allowed to slide.
Figure 4:
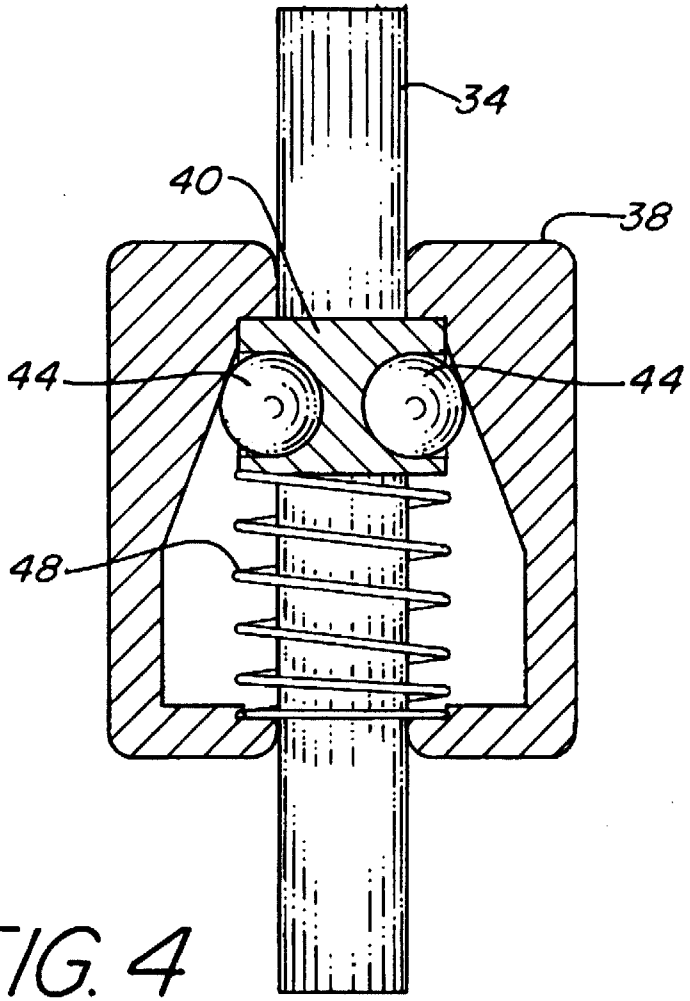
FIG. 4 is a sectional view of the variable-length clamping mechanism with the jump rope cable held firmly in place.

FIGS. 4 and 5 show, in a preferred embodiment, variable-length clamping mechanism 36. Variable length clamping mechanism 36 comprises a locking collar 38 that circumscribes jump rope cable guide 34. Locking collar 38 has an interior shaped as the frustrum of a cone, the narrower end of the frustrum being farther from the attachment head 32. Within locking collar 38, and also circumscribing the jump rope cable guide 34, is inner collar 40. While locking collar 38 may slide longitudinally along jump rope cable guide 34, inner collar 40 is rigidly attached to jump rope cable guide 34. Inner collar 40 thus limits the longitudinal movement of locking collar 38. Inner collar 40 has holes 42 that extend through it. Each hole 42 receives a ball bearing 44 that rests in hole 42. Ball bearings 44 may extend through the holes in the jump rope cable guide 34 to pinch jump rope cable 46 (not shown). Spring 48 extends circumferentially around jump rope cable guide 34 between the edge of inner collar 40 nearest handle 14 and the edge of locking collar 38. When spring 48 is extended as shown in FIG. 4, ball bearings 44 rest against a narrower section of the frustrum-shaped interior of the locking collar, thereby forcing ball bearings 44 inwardly against jump rope cable 46. Ball bearings 44 thus hold jump rope cable 46 securely in place during exercise.

To retract jump rope cable 46 within handle 14, or extend a length of jump rope cable 46 so retracted, the user pushes locking collar 38 away from attachment head 32. This action compresses spring 48, and causes ball bearings 44 to ride against a wider portion of the frustrum-shaped interior of locking collar 38 as shown in FIG. 5. This operation releases the pressure exerted by ball bearings 44 onto jump rope cable 46, allowing jump rope cable 46 to slide freely within jump rope cable guide 34. Jump rope cable 46 may now be retracted within the hollow space inside handle 14. Alternatively, jump rope cable 46 may be extended by pulling out a length that was previously retracted within the hollow space inside handle 14.

Figure 6:
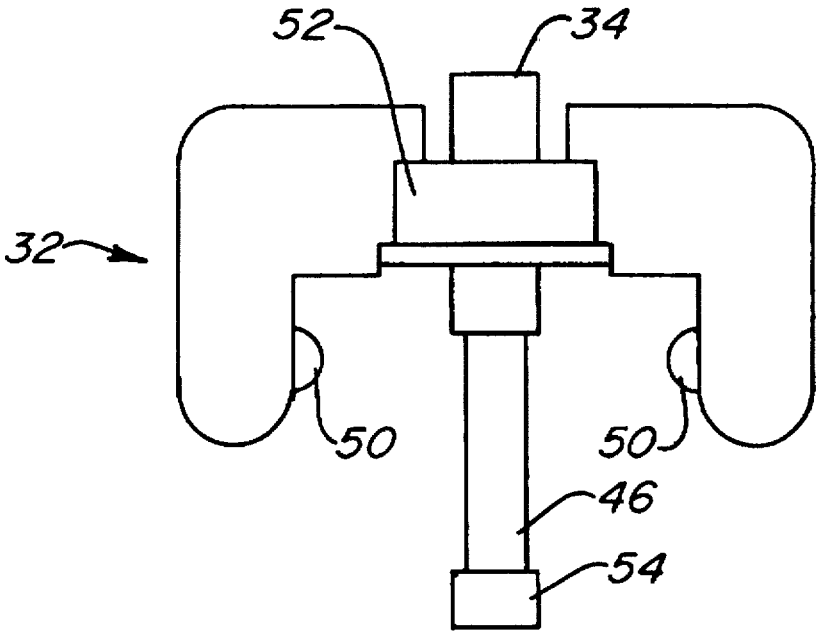
FIG. 6 is a sectional view of the jump rope unit attachment head.

Referring now to FIG. 6, the jump rope attachment assembly is described. The interior circumference of attachment head 32 features spring bearings 50. At its closed end, attachment head 32 houses precision-packed ball bearings 52. Jump rope cable guide 34 rides inside and along precision-packed ball bearings 52, allowing jump rope cable guide 34 to rotate freely about its axis. Jump rope cable 46 rides within jump rope cable guide 34. Jump rope cable 46 has a clamp 54 at each end to prevent jump rope cable 46 from slipping outside of jump rope cable guide 34. Clamp 54 thus prevents the user from accidentally pulling jump rope cable 46 completely out of attachment head 32 during length adjustment.

The rope unit may be easily detached from handle 14 if exercise without the jump rope is desired. Once attachment head 32 is slipped onto the end of handle 14, spring bearings 50 slip into a groove on the exterior circumference of handle 14 (not shown), locking attachment head 32 in place. The jump rope unit may be attached or detached from handle 14 by applying enough pushing or pulling force respectively to overcome the force exerted by the springs in the spring bearings 50.

The present invention has been described with reference to certain preferred and alternative embodiments which are intended to be exemplary only and not limiting to the full scope of the inventions as set forth in the appended claims.

What is claimed is:

1. An exercise and fitness device, comprising:

a. a pair of handles, each of said handles being hollow and having a first and second end;

b. a plurality of weight units, each of said weight units comprising:

(i) a housing with an open and closed end;

(ii) a locking means, said locking means attaching said first end of said handles to said open end of said housing; and (iii) a push button head extending from said closed end of said housing, depression of which disengages said locking means; and c. a jump rope unit, said jump rope unit comprising:

(i) a jump rope cable;

(ii) a pair of jump rope attachment assemblies each circumscribing said jump rope cable, each of said jump rope attachment assemblies locking one end of said jump rope cable into said second end of one of said handles; and (iii) a pair of variable-length clamping mechanisms, one attached to each said jump rope attachment assembly, each said variable-length clamping mechanism operable to retract said jump rope cable partially within the interior of one of said handles and to extract any portion of said jump rope cable retracted into one of said handles.

2. An exercise and fitness device according to claim 1, wherein said pair of handles each further comprises a groove along each said handle interior near said first end of each said handle.

3. An exercise and fitness device according to claim 2, wherein said locking means further comprises one or more spheres that lock into said grooves along each said handle interior when said push button is not depressed and said first end of said handle is inserted into said open end of said housing.

4. An exercise and fitness device according to claim 2, wherein said weight unit further comprises:

a. a hollow insert lying inside said housing, said insert having a flange extending radially outward that contacts the inside of said housing, and said insert having at least one hole extending through it radially, said at least one hole aligned with said groove along said handle interior when said first end of said handle is inserted into said open end of said housing;

b. a spring means that urges said push button head away from said insert;

c. a piston lying inside said housing, extending through the hollow portion of said insert, and rigidly attached to said push button head, said piston having a varying diameter such that when said push button head is extended a thicker portion of said piston lies radially under said at least one hole in said insert, and when push button head is depressed a thinner portion of said piston lies radially under said at least one hole in said insert; and d. a number of spheres equal to the number of said at least one hole in said insert, said at least one sphere being larger in diameter than said at least one hole and riding between said piston and said insert within said at least one hole, such that said at least one sphere extends outside the outer circumference of said insert when said push button is extended, and said at least one sphere lies within the outer circumference of said insert when said push button is depressed.

5. An exercise and fitness device according to claim 1, further comprising a pair of jump rope cable clamps each attached to an end of said jump rope cable, each of said jump rope cable clamps large enough in diameter to prevent said end of said jump rope cable from passing through said jump rope attachment assemblies.

6. An exercise and fitness device according to claim 5, wherein each of said pair of handles further comprises a groove along the exterior surface of each said handle near said second end, and each said jump rope attachment assembly further comprises at least one spring-loaded sphere that fits into said groove along the exterior surface of each said handle when said jump rope attachment assembly is fitted over said second end of one of said handles.

7. An exercise and fitness device according to claim 6, wherein each said jump rope attachment assembly comprises:

a. an attachment head having a closed and open end, said open end fittable over said second end of said handles;

b. a packed ball bearing unit, said packed ball bearing unit mounted in the closed end of said attachment head; and c. a jump rope cable guide, said jump rope cable guide riding inside and against said packed ball bearing unit, said jump rope cable passing through said jump rope cable guide, and said jump rope cable guide having at least one hole passing through it.

8. An exercise and fitness device according to claim 6, wherein said variable-length clamping mechanism comprises:

a. A jump rope cable guide extending out from each of said pair of jump rope attachment assemblies, said jump rope cable guide having at least one hole extending through it;

b. a locking collar the interior of which is shaped as the frustrum of a hollow cone, said locking collar circumscribing said jump rope cable guide and being movable longitudinally along said jump rope cable guide;

c. an inner collar attached to and circumscribing said jump rope cable guide and lying within said locking collar, said inner collar containing a number of holes equal to the number of said at least one hole in said jump rope cable guide, each said at least one hole in said inner collar aligning with each said at least one hole in said jump rope cable guide;

d. a number of spheres equal to the number of said at least one hole in said inner collar, said at least one sphere lying in said at least one hole in said inner collar but being too large in diameter to slide through said at least one hole in said inner collar; and e. a spring means for urging said locking collar longitudinally such that the narrower portion of the frustrum-shaped interior of said locking collar depresses said at least one sphere into said at least one hole in said inner collar and said at least one hole in said jump rope cable guide and said at least one sphere thereby contacts said jump rope cable.

* * * * *